US011156075B2

(12) United States Patent
Ramakrishnan

(10) Patent No.: US 11,156,075 B2
(45) Date of Patent: Oct. 26, 2021

(54) ADVISORY SYSTEM FOR STICK-SLIP MITIGATION IN DRILLING SYSTEMS

(71) Applicant: Halliburton Energy Services, Inc., Houston, TX (US)

(72) Inventor: Ganesh Ramakrishnan, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/588,532

(22) Filed: Sep. 30, 2019

(65) Prior Publication Data

US 2020/0157928 A1 May 21, 2020

Related U.S. Application Data

(60) Provisional application No. 62/768,536, filed on Nov. 16, 2018.

(51) Int. Cl.
*E21B 44/00* (2006.01)
*E21B 3/02* (2006.01)

(52) U.S. Cl.
CPC ..... *E21B 44/00* (2013.01); *E21B 3/02* (2013.01)

(58) Field of Classification Search
CPC ..... E21B 44/00; E21B 44/02; E21B 44/04; E21B 3/022; E21B 3/00; E21B 3/02
See application file for complete search history.

(56) References Cited

U.S. PATENT DOCUMENTS

| | | | | |
|---|---|---|---|---|
| 9,689,250 | B2 | 6/2017 | Badkoubeh et al. | |
| 2011/0186353 | A1 | 8/2011 | Turner et al. | |
| 2011/0232966 | A1 | 9/2011 | Kyllingstad | |
| 2014/0284105 | A1 | 9/2014 | Veltman | |
| 2016/0138382 | A1* | 5/2016 | Badkoubeh | E21B 3/035 175/24 |
| 2017/0370203 | A1 | 12/2017 | Hadi | |
| 2018/0371889 | A1* | 12/2018 | Hohl | E21B 44/00 |

* cited by examiner

*Primary Examiner* — Kristyn A Hall
(74) *Attorney, Agent, or Firm* — Benjamin Ford; Parker Justiss, P.C.

(57) ABSTRACT

The disclosure addresses mitigating stick-slip in drilling systems. In one example, a method of operating a drill string is disclosed for stick-slip mitigation. The method can include: 1) monitoring operation of a drill string, wherein the drill string is rotated via a top drive that is controlled by a speed controller, and (2) changing the value of at least one speed controller parameter of the speed controller in response to torsional oscillations of the drill string during the operation, wherein the value is based on a stability model for the drill string. A stick-slip mitigation advisor for drilling systems is also disclosed herein.

20 Claims, 4 Drawing Sheets

400

ADVISORY SYSTEM FOR STICK-SLIP MITIGATION IN DRILLING SYSTEMS

CROSS REFERENCE TO RELATED APPLICATION

This application claims the benefit of U.S. Provisional Application Ser. No. 62/768,536, filed on Nov. 16, 2018, entitled "MITIGATING HIGHER-ORDER STICK-SLIP IN DRILLING SYSTEMS", and incorporated herein by reference in its entirety.

TECHNICAL FIELD

This invention relates to drilling systems and, more specifically, to mitigating stick-slip torsional oscillations in a drill string.

BACKGROUND

Accessing a gas or oil well involves creating a wellbore by drilling into the earth using a drill bit. The drill bit is located at the downhole end of a drill string that includes multiple drill pipes connected together. A top drive is used at the surface of the wellbore to turn the drill string, which rotates the drill bit and extends the wellbore into the earth.

In drilling systems, a cyclic variation of the bit speed, which can range from zero to multiple times the rotational speed set at the top drive, is commonly referred to as stick-slip vibration. Such torsional oscillations are detrimental to the integrity of the drilling system, can result in drill string fatigue and bit wear, and act as delimiters of optimum performance, including high rate of penetration (ROP) and minimal nonproductive time. Therefore, surface-based damping mechanisms are commonly used to mitigate stick-slip vibration in drilling systems, and their parameters are typically chosen based on low-order models for stick-slip oscillations in the drilling system.

For example, top drive based control is typically used in the drilling industry along with proportional-integral/proportional-integral-derivative (PI/PID) controllers to minimize the reflection coefficient around the first natural frequency in torsion of the drilling system. When stick-slip is observed, control parameters for the top drive are changed based on reduced-order models of the drilling system. Stick-slip oscillations at higher modes of torsional oscillation have also been observed in field experiments indicating that these low-order models do not capture all deformation mechanisms. The higher-order torsional oscillations of the drilling system induced by the top drive can be highly detrimental to the drill string and bottom hole assembly (BHA) attached to the drill string.

SUMMARY

In one aspect, the disclosure provides a method of operating a drill string. In one example, the drill string includes: (1) monitoring operation of a drill string, wherein the drill string is rotated via a top drive that is controlled by a speed controller, and (2) changing a value of at least one speed controller parameter of the speed controller in response to torsional oscillations of the drill string during the operation, wherein the value is based on a stability model for the drill string.

In another aspect, the disclosure provides a stick-slip mitigation advisor for drilling systems. In one example, the stick-slip mitigation advisor includes: (1) an interface configured to receive drill string information of a drilling system, wherein the drilling system includes a drill string, a top drive configured to rotate the drill string, and a top drive controller that directs operation of the top drive, and (2) a processor configured to change values of control parameters of the top drive controller based on a stability model for the drill string.

The disclosure also provides a drilling system for a wellbore. In one example, the drilling system includes: (1) a top drive configured to rotate a drill string at the surface of the wellbore, (2) a top drive controller configured to direct operation of the top drive, and (3) a stick-slip mitigation advisor configured to automatically change speed controller parameters of the top drive controller based on a stability model for the drill string.

BRIEF DESCRIPTION

The disclosure may be understood by reference to the following detailed description taken in conjunction with the drawings briefly described below.

DETAILED DESCRIPTION

A set-speed controller is often used with top drives to regulate the rotational speed of the drilling system. Existing technologies to mitigate stick-slip typically target a particular frequency, or multiple frequencies of torsional oscillation by changing the integral component of the speed controller. The proportional component of the speed controller is chosen arbitrarily and the effect of changing these values on the higher-order dynamics of the drilling systems is seldom considered. The experimental and trial-and-error methods used to change the component values of the speed controller parameters do not typically take into account the interplay of the deformation mechanics of the drilling system and the surface parameters.

The disclosure recognizes the interplay between control parameters used to direct the top drive and the higher-order dynamics of the drilling system, and establishes a rationale to choose consistent parameters for the top drive that do not adversely affect the torsional dynamics of the drilling system. The disclosure provides a method, apparatus, and system that provides consistent values for top drive control parameters based on the higher order dynamics of torsional oscillations of the drilling system. For example, the integral and proportional component parameters for a set-speed controller of the top drive can be selected. The selected values can be used to alter default settings of a set-speed controller, or can be employed in conjunction with existing technologies available for mitigating stick-slip.

In contrast to existing technologies, the disclosure establishes a framework to consistently mitigate stick-slip vibrations in drilling systems realizing that torsional oscillations of the drilling systems are multi-modal, and not limited to the first mode of torsional oscillation. Therefore, the disclosed features consider the effect of the mitigation mechanism on the higher-order modes of the drilling system and employ the relationship between components, such as proportional and integral components, of a speed controller, and the higher-order dynamics of the drilling system. As such, the disclosure addresses the need to include higher-order modes of deformation in stability models for controlling torsional oscillations in drilling systems. For example, for a PI/PID speed controller, the stability models advantageously reflect the relationship of how a change in the reflection coefficient and target frequency affects the higher-order dynamics of a drilling system. Mitigating stick-slip as disclosed herein can result in improving performance of drilling tools, such as increased Rate of Penetration (ROP) and lower Nonproductive time (NPT).

Figure 4:
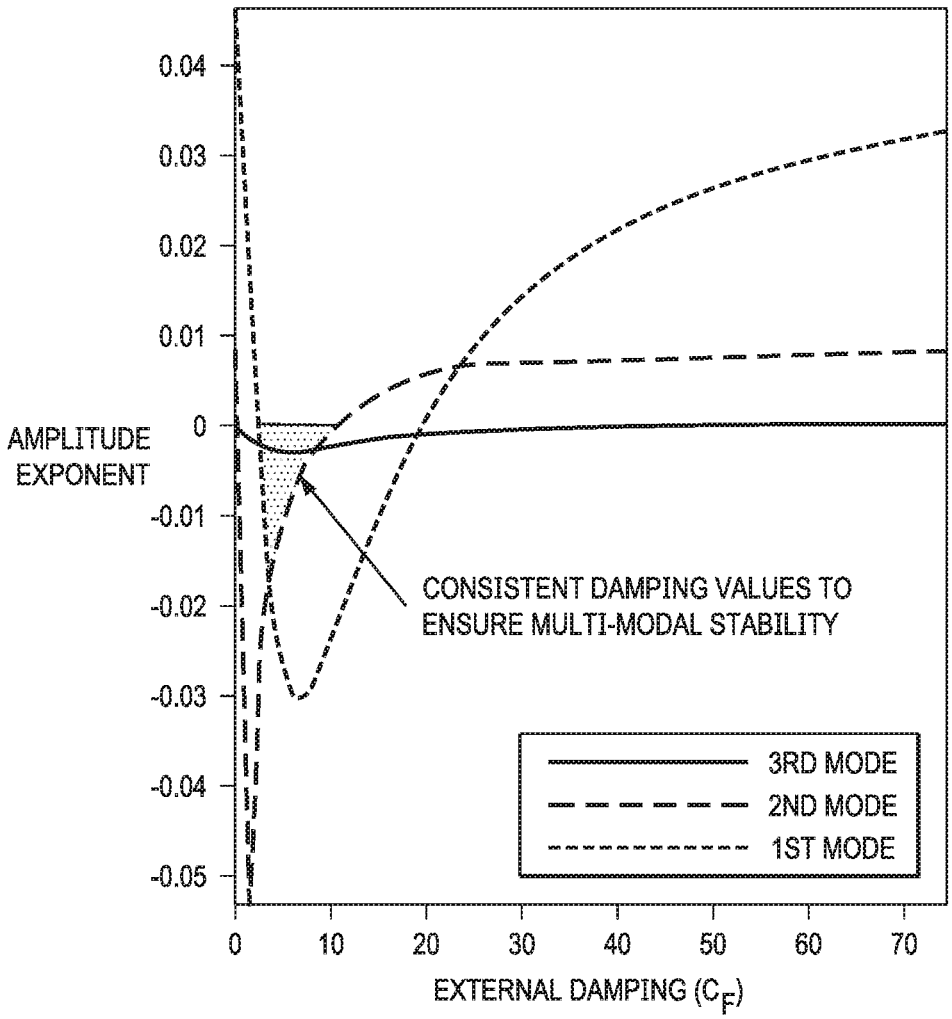
FIG. 4 illustrates a graphical example of a stability model showing multiples modes of torsional oscillations.

The features disclosed herein also consider how surface equipment of a drilling system work in conjunction with the actual drilling system. The stability models that are employed accurately predict or describe self-excited torsional oscillations for drilling systems, and a metric is developed from the stability model to couple both a surface mitigation mechanism, such as a top drive speed controller, and the drilling system. The stability model represents the relationship between the stability of the drilling system and the external damping and stiffness coefficient, for multiple torsional oscillation modes of a drill string. A sample chart, stability chart 400, representing the relationship is illustrated in FIG. 4.

The stability chart 400 indicates the relationship between torsional stick-slip oscillations and the parameters of a top drive based control system, and provides a stability criterion that establishes the interaction between the parameters of a surface-based stick-slip mitigation mechanism and the higher-order dynamics of a drilling system.

The stability models, such as represented by the stability chart 400, disclosed herein can serve as the building block for a decision tree for automated drilling systems that maximize performance and concurrently avoid drilling dysfunctions. As noted above, top drives often feature a speed controller, which acts as a spring-mass damper for the nonlinear oscillations established in the drilling system. Therefore, to stabilize the system, the absorber/speed controller attached to the top end of the drill string needs to be able to counteract the amplification of the perturbation at the lower end. However, the relationship between the excitation and absorption mechanism is not linear because the corresponding sources (bit and top drive) are connected by a long, flexible torsional system. This relationship can be obtained from the stability models for the system that provide the relationship between the external damping applied at the top drive and the first-order nonlinearity in the drilling system that delineates the amplification/dissipation of the different modes of the drilling system as a function of the surface damper parameters. The stability models show that, in addition to targeting a particular mode, the damping coefficient should also be chosen carefully to avoid shifting the instability of the system to a higher mode of oscillation. If a derivative component is also used in the speed controller, then the frequency targeted should be modified accordingly, and the corresponding stability chart needs to be employed. As mentioned above, the disclosure recognizes that speed controllers used to regulate the top drive RPM act as vibration absorbers for the drilling system. For a given configuration of the drill string and operating parameters, an amplitude exponent that governs the stability of each mode of torsional oscillation as a function of the controller parameters can be determined, as represented by Equation 1 shown below.

$$\dot{a}_i = \lambda_i a_i;\ \lambda_i = H_i - \frac{\hat{c}_f}{(\omega_i^2 - \omega_0^2) + \hat{c}_f^2 \omega_i^2}, \qquad \text{Equation 1}$$

In Equation 1, $\lambda$ can be referred to as the rate of growth of the amplitude (or amplitude exponent), $\dot{a}_i$ is the slope of the amplitude exponent $a_i$ (the derivative of the amplitude with respect to time), and $\hat{c}_f$ is the nondimensional damping coefficient applied at the top drive (or the proportional component of the speed controller). $\omega_i$_is the natural frequency of the $i^{th}$ mode of the drilling system, and $\omega_0$, which represents an integral component of Equation 1, is the natural frequency associated with the top drive. If the speed controller also has a non-zero derivative component, such as a non-zero component, then $\omega_0$ would also have a contribution due to this derivative component. H is a vector, wherein $H_i$ is a parameter that depends on the magnitude of external excitation, and the mode shapes of the system.

A negative value of the amplitude exponent ($\lambda_i$) implies that the corresponding mode is stable, whereas a positive value implies that the corresponding mode is unstable. The amplitude exponent of each mode depends on its natural frequency and mode shape, the operational parameters (given by H), and the parameters of the surface damper (speed controller and top drive inertia). As disclosed herein, for a set of given operational parameters and drill string configuration, a stability model that relates the amplitude exponent to the surface damper parameters can be generated. From the stability model, a range of values can be determined for changing the speed controller parameters for torsional oscillation mitigation. FIG. 4 provides an example of stability model represented as a stability chart where the region of parameter values that ensure multi-modal stability is highlighted.

The disclosure demonstrates that, for a proportional-integral speed controller, with a particular choice of integral component of the speed controller, the proportional component needs to be appropriately chosen in order to ensure stick-slip vibrations are mitigated. The logic for selecting the appropriate values for the control parameters can be built into a decision tree, which uses the stability models to iteratively determine the optimal speed controller parameters to mitigate stick-slip vibrations. The iterative nature of the decision tree is attributed to the changing nature of bit-rock interaction, and operational parameters. Furthermore, for the given mode shape and the operational parameters, the modes may not be stable for any chosen damping value (due to operating parameter choices, changes in bit condition etc.). In such cases, it is beneficial to indicate that other external choices must be made, i.e., the operating parameters need to be changed, or if drilling is continued with stick-slip, it must be established at the fundamental mode of torsional oscillation (any higher-mode oscillation will result in a higher number of fatigue cycles, thereby resulting in accelerated wear of BHA components). This framework to highlight limits of the mitigation mechanism is also incorporated in the decision tree.

As noted above, the disclosure provides an iterative technique in the form of a decision tree for automated drilling systems that maximize performance and concurrently avoid drilling dysfunctions. The logic for one example of torsional oscillation mitigation as disclosed herein is illustrated in the flow diagram of FIG. 3. The logic can represent an algorithm and can reside in a stick-slip mitigation advisor such as mentioned in FIG. 1.

Figure 1:
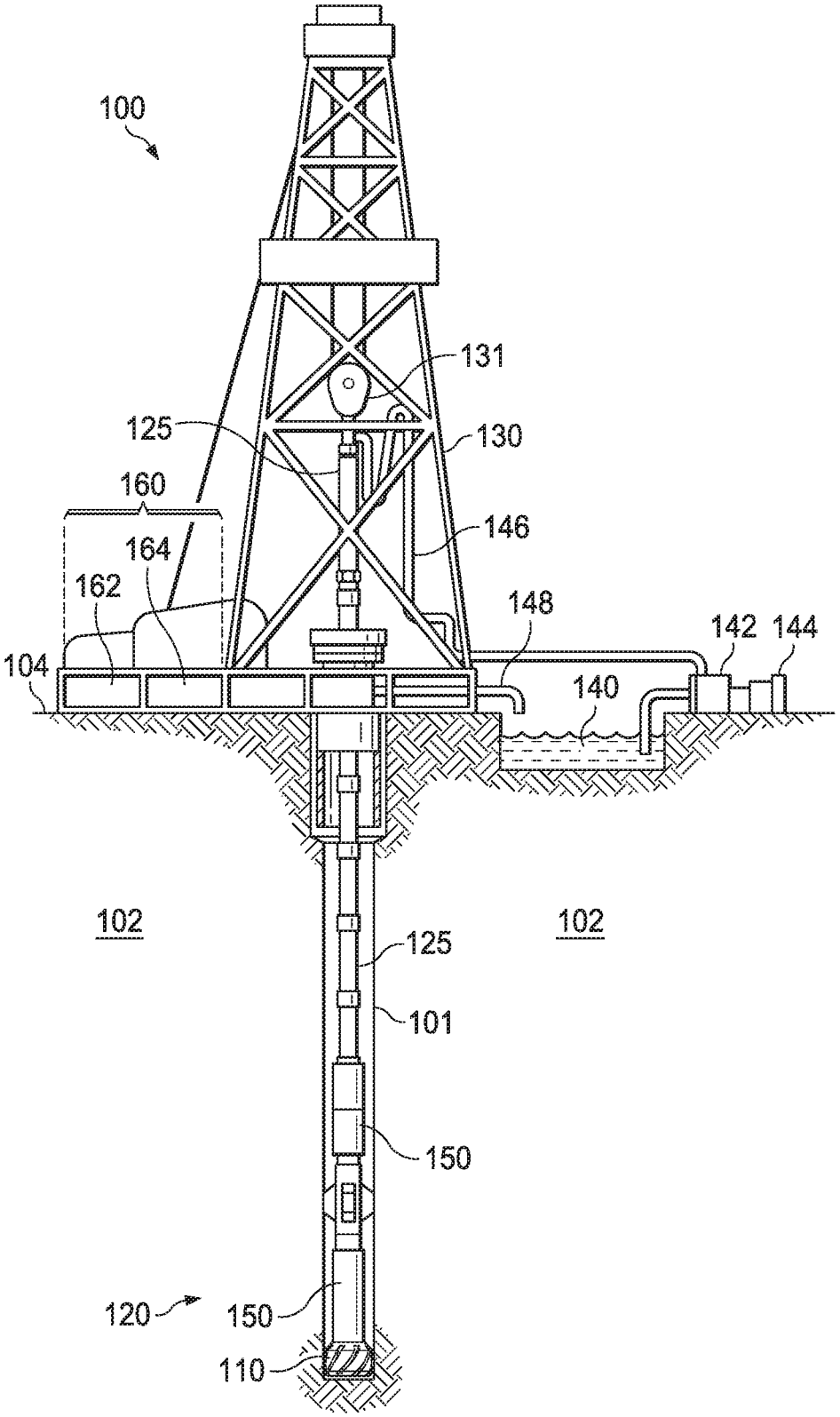
FIG. 1 illustrates a logging while drilling (LWD) system configured to perform formation drilling to create a wellbore.

FIG. 1 illustrates a logging while drilling (LWD) system 100 configured to perform formation drilling to create a wellbore 101. The LWD system 100 includes a BHA 120 that includes a drill bit 110 that is operatively coupled to a tool string 150, which may be moved axially within the wellbore 101. During operation, the drill bit 110 penetrates the earth 102 and thereby creates the wellbore 101. BHA 120 provides directional control of the drill bit 110 as it advances into the earth 102. Tool string 150 can be semi-permanently mounted with various measurement tools (not shown) such as, but not limited to, measurement-while-drilling (MWD) and logging-while-drilling (LWD) tools, that may be configured to take downhole measurements of drilling conditions and geological formation of the earth 102.

The LWD system 100 is configured to drive the BHA 120 positioned or otherwise arranged at the bottom of the drill string 125 extended into the earth 102 from a derrick 130 arranged at the surface 104. The LWD system 100 includes a top drive 131 that is used to rotate the drill string 125 at the surface 104, which then rotates the drill bit 110 in the wellbore 101. Operation of the top drive 131 is controlled by a top drive controller. The LWD system 100 can also include a kelly and a traveling block that is used to lower and raise the kelly and drill string 125.

Fluid or "drilling mud" from a mud tank 140 may be pumped downhole using a mud pump 142 powered by an adjacent power source, such as a prime mover or motor 144. The drilling mud may be pumped from mud tank 140, through a stand pipe 146, which feeds the drilling mud into drill string 125 and conveys the same to the drill bit 110. The drilling mud exits one or more nozzles arranged in the drill bit 110 and in the process cools the drill bit 110. After exiting the drill bit 110, the mud circulates back to the surface 104 via the annulus defined between the wellbore 101 and the drill string 125, and in the process, returns drill cuttings and debris to the surface. The cuttings and mud mixture are passed through a flow line 148 and are processed such that a cleaned mud is returned down hole through the stand pipe 146 once again.

Figure 2:
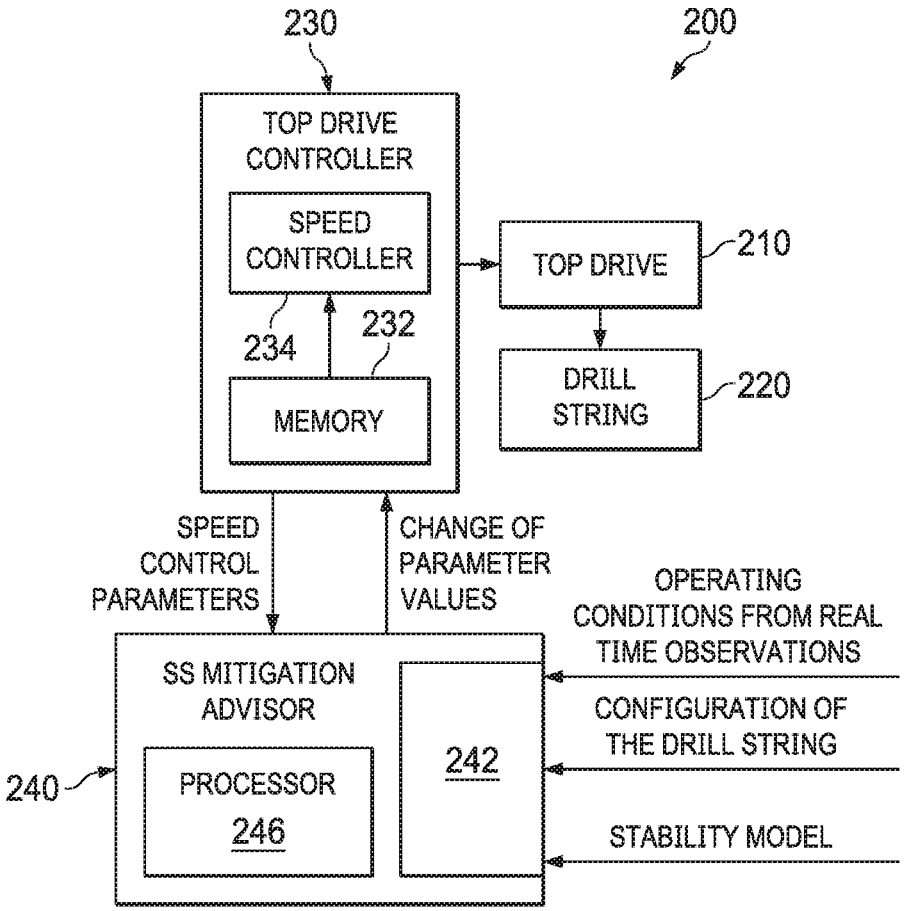
FIG. 2 illustrates a block diagram of an example of a drilling system constructed according to the principles of the disclosure.

A controller 160 including a processor 162 and a memory 164 may direct operation of the LWD system 100. A communication channel may be established by using, for example, electrical signals or mud pulse telemetry for most of the length of the tool string 150 from the drill bit 110 to the controller 160. The controller 160 can also be configured to perform the functions of the top drive controller and a stick-slip mitigation advisor such as illustrated in FIG. 2. In some examples, a separate computing device from the controller 160 can be used to perform the functions of a top drive controller and a stick-slip mitigation advisor as disclosed herein. Regardless the implementing device or location, the top drive controller communicates controls to the top drive via a conventional wired or wireless communication medium.

FIG. 2 illustrates a block diagram of an example of a drilling system 200 constructed according to the principles of the disclosure. The drilling system 200 includes a top drive 210, a drill string 220, a top drive controller 230, and a stick-slip mitigation advisor 240. Typically, a BHA (not illustrated in FIG. 2) is coupled to the drill string 220 as represented in FIG. 1. The top drive 210 rotates the drill string 220 that in turn rotates a drill bit (not shown) within a wellbore. The top drive 210 and the drill string 220 can be conventional components of a drilling system typically employed in the industry.

The top drive controller 230 controls the operation of the top drive 210 and can employ control parameter values provided by the stick-slip mitigation advisor 240 to mitigate torsional oscillations due to stick-slip. The top drive controller 230 includes a memory 232 and a speed controller 234. The memory 232 stores computer executable instructions and the speed controller 234 controls the rotational speed of the top drive. In one example, the memory 232 stores instructions that, when executed, perform the function of the speed controller 234 for the top drive 210. As such, the speed controller 234 can be implemented on a processor that employs the operating instructions from the memory 232. The speed controller 234 can include a proportional-integral (PI) controller such as employed in typical top drive speed controllers. The speed controller 234 can employ speed controller parameter values calculated by the stick-slip mitigation advisor 240. The top drive controller 230 and the stick-slip mitigation advisor 240 are shown as separate and distinct from the top drive 210 and from each other. In some example, the top drive 210, the top drive controller 230, and the stick-slip mitigation advisor 240 or at least two of these can be integrated together, or at least located proximate one another.

The stick-slip mitigation advisor 240 includes an interface 242 and a processor 246. The interface 242 is configured to communicate data, i.e., transmit and receive data. As such, the interface 242 includes the necessary logic, ports, terminals, etc., to communicate data. As illustrated, the interface 242 can receive feedback from the drilling system 200 that provides operating conditions. The operating conditions can be received in real time and indicate the current operating conditions of the drill string 220. The operating conditions can be received from, for example, the top drive controller 230 or the top drive 210, and can include the downhole revolutions per minute (RPM) of the drill string 220, the stick-slip index (SSI), Fast Fourier Transform (FFT) of the RPM or downhole torque, and/or acceleration intensity and frequencies. The operating conditions can be transmitted to the stick-slip mitigation advisor 240 via conventional communication methods used with a drilling system.

The stick-slip mitigation advisor 240 is configured to change control parameters of the top drive controller 230 based on a stability model for the drill string 220, the top drive controller 230, and the speed controller 234. The stick-slip mitigation advisor 240 can change the parameter values, or at least one of the parameter values of the top drive controller 230 when stick-slip of the drill string 220 is observed or determined, such as from the operating conditions. The parameters can be speed control parameters for the speed controller 234. For example, the parameters can be the proportional and integral coefficients used by the speed controller to control operation of the top drive 210, and the stability model such as represented by Equation 1.

Figure 3:
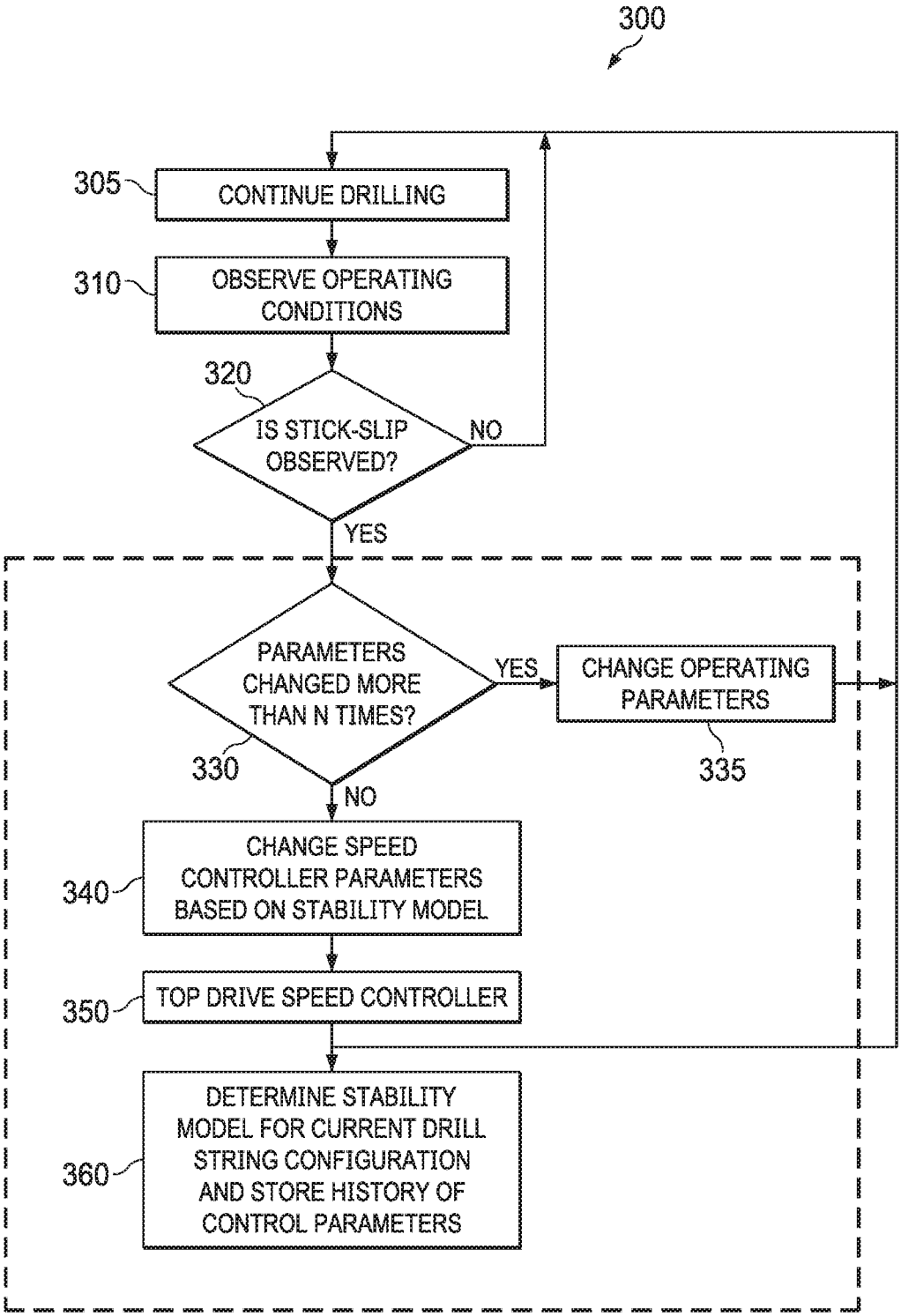
FIG. 3 illustrates a flow diagram of an example of a method of mitigating stick-slip vibrations in a drilling system.

FIG. 3 illustrates a flow diagram of an example of a method 300 of mitigating stick-slip vibrations in a drilling system. The method 300 represents an algorithm that considers higher order dynamics of a drilling system when choosing controller parameters. The method 300 is an iterative process that occurs during a drilling operation and is directed to damp the stick-slip oscillations by automatically changing speed controller parameters, or at least reduce the oscillations by changing the operational parameters of the drilling system. Determining whether to change the operational parameters or change the speed controller parameters can be based on a number of times "n" that the speed controller parameters have been changed. The value of "n" can be determined by the user. In some examples, the value of "n" can be in the range from ten to twenty five. The decisional steps in the dashed box can be represented by logic that is part of a stick-slip mitigation advisor as disclosed herein, such as stick-slip mitigation advisor 240. Accordingly, at least some of the steps of the method 300 can be performed by stick-slip mitigation advisor as disclosed herein. The method 300 begins in a step 305 after drilling in a wellbore has already started.

In a step 310, operating conditions of the drilling are observed. The operating conditions provide feedback of the drill string during drilling and can be observed by employing conventional methods and equipment that are used to observe and report downhole drilling conditions. The operating conditions can include the downhole RPM, the SSI, the FFT of RPM, and/or other factors that indicate the nature of torsional oscillations being observed downhole. The operating conditions can be observed and reported in real time. In certain cases, surface-based measurements of torque supplied to the top drive can also be used. A torque sensor coupled with the top drive or the top drive itself could provide the torque measurements. The operating conditions can be received by a stick-slip mitigation advisor, such as the stick-slip mitigation advisor 240.

In a first decisional step 320, a determination is made if stick-slip is observed. The determination can be based on the operating conditions that have been observed and received. The stick-slip can be associated with one of multiple modes of torsional oscillations of the drill string. If stick-slip is not observed, the method 300 continues to step 305 and drilling continues.

If stick-slip is observed, the method 300 continues to a second decisional step 330 that determines if the number of times that the speed control parameters have been changed is more than a predetermined number "n". As noted above, the value of "n" can be in the range from 10 to 25. In some examples, the value of "n" can change depending on the stability model that is being used. For example, "n" can vary based on the drill string configuration. In other words, a more complex stability model may require more iterations. A counter can be used to indicate the number of times "n" that the speed control parameters have been changed. For example, the counter can indicate the number of times that step 340 has occurred. The method 300 may not need to perform iterations, such as when H is known. For example, H can be determined by downhole sensors and then sent to the surface.

If the speed control parameter values have been changed fewer times than the number "n", then the method 300 continues to step 340 where the speed controller parameter values are changed based on a stability model for the drill string. The first stability model that is employed in the method 300, i.e., for the first iteration, can be predetermined before drilling begins in step 305, and can be based on the original drilling configuration of the drill string. The stability models can be dynamically changed in step 360 based on updated speed controller parameter values and updated drill string configuration. The speed controller parameters, i.e., the values of the speed controller parameters, are changed to mitigate torsional oscillations of the drill string. The changed values, or value, are provided to the top drive controller.

In a step 350, the top drive controller receives the changed speed controller parameters. The speed controller changes the operating speed of the top drive employing the speed controller parameter values and drilling can continue in step 305. The actual speed controller parameter values and other parameters employed by the top drive are used to update the stability model of the drill string in step 360. The actual speed controller parameter values can be provided by the top drive controller to the stick-slip mitigation advisor. The actual speed controller parameter values can be used to determine the current location within the range of values of the stability model as well as knowing the history of parameters that have been set. Updating of the history and updating the stability model, if needed, for the next loop of the method 300 can then be performed in step 360.

In step, 360, the stability model is selected based on the existing speed controller parameters and the drill string configuration. The stability model can be predetermined before the drilling operation based on the known drill string configuration and initial operating parameters of the top drive controller, and used for the first iteration. The drill string configuration and the operating parameters can change during the drilling process and be updated in real time to allow real time selection of the appropriate stability model. The drill string configuration may not have changed during the drilling operation. As such, the drill string configuration can be the same as before the drilling began. The drill string configuration can change, however, during the drilling process. For example, an additional stand can be added to the drill string as the drilling depth increases. The stability model is selected for the existing drilling configuration (which could be a new configuration) and the current speed controller parameters. The selected stability model is then used for step 340.

Returning now to the second decisional step 330, the method 300 continues to step 335 when the speed controller parameters have been changed a greater number of times than n. In step 335, advice to change the operational parameters for the drilling string can be provided. The operational parameters can be the RPM of the top drive, the WOB, and the flow rate of mud. The operational parameters can be changed as typically performed in drilling systems and used for the drilling in step 305. The iterative and automatic method 300 can continue as long the drilling continues.

FIG. 4 illustrates a graphical example of a stability model, referred to as a stability chart 400, showing multiples modes of torsional oscillations. The stability chart 400 represents the interplay of the parameters of the top drive controller and the higher-order torsional dynamics of a drilling system. For the drilling system, the rate of growth of amplitude of the natural modes as a function of the surface damper parameters is shown to depend on the operational parameters and on the configuration of the drill string.

The stability chart 400 includes a shaded area that indicates consistent damping values that can be used to ensure multi-modal stability. The shaded area provides a range of values for speed controller parameters that can be used to mitigate the torsional oscillations. The shaded area corresponds to the iterative method represented in FIG. 3 that is solving for H when H is unknown.

In some examples of different drilling conditions, the different modes or a combination thereof can matter more than other modes. In one aspect, the first and the third can matter more than the second or it could be that only the first two modes matter. As such, the shaded area would change to reflect the range of values, which is part of the iterative process that occurs within the stick-slip mitigation advisor.

A portion of the above-described apparatus, systems or methods may be embodied in or performed by various analog or digital data processors, wherein the processors are programmed or store executable programs of sequences of software instructions to perform one or more of the steps of the methods. The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

Those skilled in the art to which this application relates will appreciate that other and further additions, deletions, substitutions and modifications may be made to the described embodiments.

Various aspects of the disclosure can be claimed including the apparatuses, systems and methods as disclosed herein including:

A. A method of operating a drill string including: (1) monitoring operation of a drill string, wherein the drill string is rotated via a top drive that is controlled by a speed controller, and (2) changing a value of at least one speed controller parameter of the speed controller in response to torsional oscillations of the drill string during the operation, wherein the value is based on a stability model for the drill string.

B. A stick-slip mitigation advisor for drilling systems, including: (1) an interface configured to receive drill string information of a drilling system, wherein the drilling system includes a drill string, a top drive configured to rotate the drill string, and a top drive controller that directs operation of the top drive, and (2) a processor configured to change values of control parameters of the top drive controller based on a stability model for the drill string.

C. A drilling system for a wellbore, including: (1) a top drive configured to rotate a drill string at the surface of the wellbore, (2) a top drive controller configured to direct operation of the top drive, and (3) a stick-slip mitigation advisor configured to automatically change speed controller parameters of the top drive controller based on a stability model for the drill string.

Each of aspects A, B and C can have one or more of the following additional elements in combination.

Element 1: further comprising changing at least one operational parameter of the drill string based on a number of times speed controller parameters have been changed during the operation. Element 2: further comprising determining the stability model based on a configuration of the drill string. Element 3: further comprising determining the stability model based on a configuration of the drill string and operating conditions of the drill string. Element 4: wherein determining the stability model is further based on speed controller parameters of the speed controller. Element 5: wherein the method is an iterative method. Element 6: wherein the method is an automatic method. Element 7: wherein the at least one speed controller parameter is associated with a damping parameter. Element 8: wherein the stability model is for multiple modes of torsional oscillations of the drill string and provides a range of values for speed controller parameters that mitigate multiple modes of torsional oscillations. Element 9: wherein the control parameters are speed controller parameters of a speed controller of the top drive controller. Element 10: wherein the stability model is based on a configuration of the drill string. Element 11: wherein the stability model is based on a configuration of the drill string and operating conditions of the drill string. Element 12: wherein the stability model is based on a configuration of the drill string, operating conditions of the drill string, and values of speed control parameters of the top drive controller. Element 13: wherein the stability model corresponds to multiple modes of torsional oscillations of the drill string. Element 14: wherein the processor is configured to automatically change the values of the control parameters during operation of the drill string. Element 15: wherein the stability model is predetermined before operation of the drill string, is based on a configuration of the drill string, and corresponds to multiple modes of torsional oscillations of the drill string. Element 16: wherein the stick-slip mitigation advisor is configured to receive operating conditions about the drill string and employ the operating conditions for determining the stability model. Element 17: wherein the stick-slip mitigation advisor is further configured to, based on a number of times the speed controller parameters have been changed, change operational parameters of the drilling system instead of changing the speed controller parameters.

What is claimed is:

1. A method of operating a drill string, comprising:

monitoring operation of a drill string, wherein the drill string is rotated via a top drive that is controlled by a speed controller; and changing, in response to torsional oscillations of the drill string during the operation, a value of at least one of speed controller parameters of the speed controller based on a stability model for the drill string that determines an effect of the speed controller parameters on multiple torsional oscillation modes of the drill string.

2. The method as recited in claim 1, further comprising changing at least one operational parameter of the drill string based on a number of times the speed controller parameters have been changed during the operation.

3. The method as recited in claim 1, further comprising determining the stability model based on a configuration of the drill string.

4. The method as recited in claim 1, further comprising determining the stability model based on a configuration of the drill string and operating conditions of the drill string.

5. The method as recited in claim 1, further comprising determining the stability model based on the speed controller parameters of the speed controller.

6. The method as recited in claim 1, wherein the method is an iterative method.

7. The method as recited in claim 1, wherein the method is an automatic method.

8. The method as recited in claim 1, wherein the at least one of the speed controller parameters is associated with a damping parameter.

9. The method as recited in claim 1, wherein the stability model provides a range of values for the speed controller parameters that mitigate the multiple modes of torsional oscillations.

10. A stick-slip mitigation advisor for drilling systems, comprising:

an interface configured to receive drill string information of a drilling system, wherein the drilling system includes a drill string, a top drive configured to rotate the drill string, and a top drive controller that directs operation of the top drive; and a processor configured to change values of control parameters of the top drive controller based on a stability model for the drill string that determines an effect of speed controller parameters of a speed controller of the top drive on multiple torsional oscillation modes of the drill string.

11. The stick-slip mitigation advisor as recited in claim 10, wherein the control parameters are the speed controller parameters of the speed controller of the top drive controller.

12. The stick-slip mitigation advisor as recited in claim 10, wherein the stability model is based on a configuration of the drill string.

13. The stick-slip mitigation advisor as recited in claim 10, wherein the stability model is based on a configuration of the drill string and operating conditions of the drill string.

14. The stick-slip mitigation advisor as recited in claim 10, wherein the stability model is based on a configuration of the drill string, operating conditions of the drill string, and values of the speed control parameters.

15. The stick-slip mitigation advisor as recited in claim 10, wherein the stability model corresponds to stability of the drilling system and an external damping and stiffness coefficient for the multiple modes of torsional oscillations of the drill string.

16. The stick-slip mitigation advisor as recited in claim 10, wherein the processor is configured to automatically change the values of the control parameters during operation of the drill string.

17. A drilling system for a wellbore, comprising:

a top drive configured to rotate a drill string at the surface of the wellbore;

a top drive controller configured to direct operation of the top drive; and a stick-slip mitigation advisor configured to automatically change speed controller parameters of the top drive controller based on a stability model for the drill string that determines an effect of the speed controller parameters on multiple torsional oscillation modes of the drill string.

18. The drilling system as recited in claim 17, wherein the stability model is predetermined before operation of the drill string and is based on a configuration of the drill string.

19. The drilling system as recited in claim 17, wherein the stick-slip mitigation advisor is configured to receive operating conditions about the drill string and employ the operating conditions for determining the stability model.

20. The drilling system as recited in claim 17, wherein the stick-slip mitigation advisor is further configured to, based on a number of times the speed controller parameters have been changed, change operational parameters of the drilling system instead of changing the speed controller parameters.

* * * * *